United States Patent [19]

Schmidt

[11] 3,938,162

[45] Feb. 10, 1976

[54] VARIABLE BEAMWIDTH ANTENNA

[75] Inventor: Richard F. Schmidt, Seabrook, Md.

[73] Assignee: The United States of America as represented by the United States National Aeronautics and Space Administration Office of General Counsel-Code GP, Washington, D.C.

[22] Filed: Aug. 27, 1974

[21] Appl. No.: 500,979

[52] U.S. Cl. ..... 343/840; 343/837; 343/912; 343/915

[51] Int. Cl.[2] ..... H01Q 19/12; H01Q 15/14

[58] Field of Search ..... 343/840, 837, 781, 914, 343/915, 912, 916

[56] References Cited

UNITED STATES PATENTS

| | | | |
|---|---|---|---|
| 3,254,342 | 5/1966 | Miller | 343/915 X |
| 3,365,720 | 1/1968 | Kelleher | 343/840 X |
| 3,852,765 | 12/1974 | Bresler et al. | 343/837 X |

OTHER PUBLICATIONS

Double Parobolic Cylinder Pencil–Beam Antenna, Spencer et al., IRE Trans.–Antennas and Propagation, Jan. 1955, pp. 4–8.

*Primary Examiner*—Archie R. Borchelt
*Assistant Examiner*—E. R. LaRoche
*Attorney, Agent, or Firm*—R. F. Sandler; John R. Manning

[57] ABSTRACT

An antenna system for single or plural beams providing continuously variable beamwidth selectively in one or both of two orthogonal senses, i.e., azimuth and elevation, for either communications or angle-tracking. The system includes two parabolic cylindrical reflectors, which are respectively a main reflector and a sub-reflector; the reflectors are positioned with the focal axes thereof orthogonally. A point or multibeam (e.g., monopulse) feed is mounted adjacent the main reflector on the focal axis of the sub-reflector in the Airy disc of the system. Beamwidth is controlled using telescoping sections on the main and sub-reflectors to control the size of the surface areas thereof. Simultaneous operation of the telescoping sections of the reflector and sub-reflector provides bidirectional zooming of the beam without distortion while individual operation of the sections of the reflectors permits unidirectional zooming. Bidirectional zooming of beams from the multibeam feed requires rotating the position of the multibeam feed as the Airy disc changes during adjustment of the telescoping sections.

26 Claims, 9 Drawing Figures

VARIABLE BEAMWIDTH ANTENNA

ORIGIN OF THE INVENTION

The invention described herein was made by employees of the United States Government and may be manufactured and used by or for the Government for governmental purposes without the payment of any royalties thereon or therefor.

FIELD OF THE INVENTION

The present invention relates generally to antenna systems for controlling the beamwidth of a pencil beam or a multibeam such as a monopulse beam and, more particularly, to antenna systems including a pair of parabolic, cylindrical reflectors having mutually orthogonal axes.

BACKGROUND OF THE INVENTION

In both cooperative and non-cooperative angle-tracking, a beam derived from an antenna scans a search area in order to determine the path of a target and to predict its future position. If the antenna has a narrow pencil beam pattern and if the search is large, a relatively long scanning time is required to locate a target in the search area. On the other hand, if the antenna pattern is a wide pencil beam scanning time is relatively short but the tracking accuracy is reduced. In some applications, the tracking characteristics of both wide and narrow beams are required in the same system. Consequently, a versatile radar antenna should have the capability of selectively providing wide and narrow pencil beam radiation pattern depending on the particular target area and required resolution.

One radiation pattern commonly employed with tracking radar is a symmetrical pencil beam in which the elevation and azimuth beamwidths are essentially equal. In order to vary beamwith of a pencil beam radiation pattern, prior art systems include means for moving the system with respect to the reflector of the antenna to defocus the beam, or means for slightly warping the reflector to change the focal length thereof. Although defocusing can provide continuous bidirectional beamwidth control, surface warping is extremely cumbersome and inaccurate. Other prior art systems use "venetian blind" portions or fired diode arrays on the surface of a reflector to control beamwidth but are effective only with respect to either vertically or horizontally polarized waves and cannot be incorporated into a system using, for example, circularly polarized waves. To my knowledge, there is no antenna system capable of selectively providing accurate continuous beamwidth adjustment in one of or both elevation and azimuth while allowing free choice of polarization.

One disadvantage of a pencil beam scanning radar system is that the measurement of a target position in azimuth and elevation requires a plurality of pulses to be processed. For example, in practice, at least four pulses are required in sequential lobing and generally more than four are required in conical scan systems. During the measurements period in these systems, various noise components contribute to the degradation of the system, e.g., the modulation components caused by a fluctuating target cross-section tend to obscure error signals indicative of target position. This degradation is avoided in monopulse, or simultaneous lobing, which uses one pulse rather than plural pulses to track a target.

In monopulse systems, r.f. signals received from four offset antenna beams, derived from a plurality of feeds, e.g., four, offset a small distance from each other at the focal region of the antenna, are combined and processed so that both sum and difference signals are then multiplied in a phasesensitive detector to obtain both the magnitude and direction of the error signal. The antenna can include a single reflector, such as a parabolic dish, or multiple reflectors, as typified by Cassegrain or Gregorian antennas. However, systems including multiple reflectors generally require a sub-reflector to be positioned directly in the aperture. The sub-reflector disadvantageously blocks the radiation and reduces the efficiency of the system.

In order to minimize the main reflector obscurations, it has been proposed in U.S. Pat. No. 2,825,063 to Spencer to provide a pair of confocal parabolic cylinders positioned with their focal axes orthogonally to function as a main reflector and a sub-reflector. A point source radiant energy feed placed on the sub-reflector focal axis adjacent the main reflector transduces a spherical wave that is converted into a virtual cylindrical wave sector at the sub-reflector and emanates as a plane wave from the main reflector. While the Spencer antenna performs generally satisfactorily as a pencil beam antenna, I know of no practical means for controlling the beamwidth in azimuth and elevation in antennae of the type disclosed by Spencer. Prior attempts to incorporate a multibeam feed in place of the point source in the Spencer system have produced badly distorted radiation patterns. For example, the multibeam feed was first positioned parallel to the aperture plane of the subreflector and then generally in the focal region of the antenna. The radiated pattern in both cases was found to be severely distorted rendering the double parabolic cylinder antenna unusable as a multibeam antenna.

BRIEF DESCRIPTION OF THE INVENTION

In accordance with one aspect of the present invention, an antenna system capable of effecting a continuously variable beamwidth control of a pencil beam selectively in azimuth and elevation is provided in a double parabolic cylinder antenna by incorporating telescoping sections on the main reflector and sub-reflector to control the size of the surface area of each reflector, thereby controlling the aperture size of the antenna. In accordance with another aspect, a multibeam feed, e.g., a monopulse feed is positioned in the Airy disc. The multibeam feed is rotated to remain within the Airy disc during zooming, thereby providing a highly efficient multibeam system having continuously variable bidirectional zooming of the squinted beams.

In the present invention, in order to control the elevation and azimuth beamwidths in the double parabolic cylinder antenna, the sub-reflector and main reflector areas are respectively varied, thereby changing the aperture size in elevation and azimuth. To these ends, a telescoping section is provided on the sub-reflector to slide parallel to the sub-reflector focal axis to control the axial length of the sub-reflector and similar telescoping sections are provided at each end of the main reflector. By selectively adjusting the telescoping sections, continuous bidirectional zooming is provided.

In multibeam operation, as the telescoping section of the sub-reflector area is changed, the position of the Airy disc rotates due to non-symmetrical changes in geometry of the antenna. To avoid severe distortion of the multibeam pattern, the multibeam feed is rotated so it is maintained within the Airy disc.

In one modification, the sub-reflector and feed are rotated about the focal axis of the main reflector to the extent that the feed be positioned behind the main reflector to view the sub-reflector through an opening in the main reflector. Although main aperture obscuration is decreased, bidirectional zooming is provided with telescoping sections on both the main reflector and sub-reflector.

Although the main reflector and sub-reflector intersect at a parametric curve, in practice, the main reflector is truncated at a plane tangent to the sub-reflector and parallel to the focal axis of the main reflector to provide a rectilinear boundary.

OBJECTS OF THE INVENTION

Accordingly, one object of the present invention is to provide a new and improved antenna.

Another object of the present invention is to provide a new and improved antenna using a point source.

Still another object of the present invention is to provide a new and improved antenna whose zooming function is independent of frequency and beam polarization.

Yet another object of the present invention is to provide a new and improved multibeam antenna wherein blockage of the aperture by the feed and sub-reflector is eliminated.

One other object of the present invention is to provide a new and improved antenna capable of bidirectional beam zooming.

Still another object of the present invention is to provide a new and improved directional antenna capable of both bidirectional and symmetrical beam zooming.

Another object of the present invention is to provide a new and improved antenna wherein beam characteristics are preserved during zooming.

Yet another object of the present invention is to provide a new and improved multibeam antenna having bidirectional beam zooming capability.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1B:
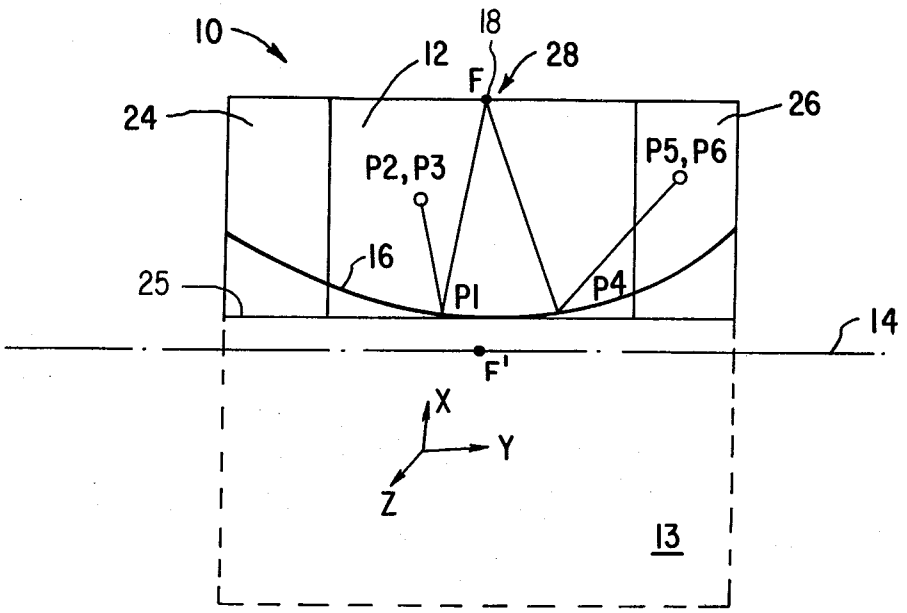
FIGS. 1A and 1B are respectively side and front views of the antenna according to the present invention with the telescoping sections opened.
Figure 1A:
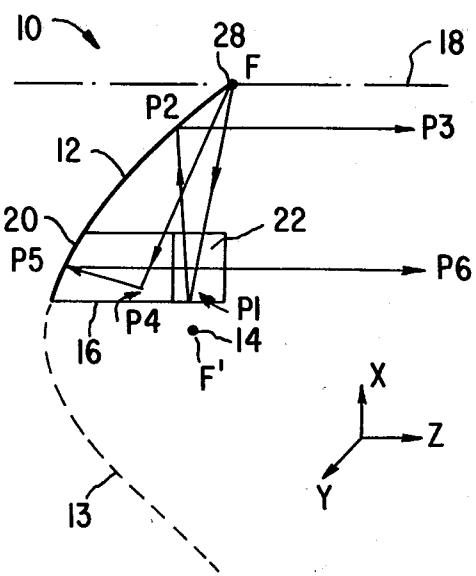

Reference is now made to FIGS. 1A and 1B wherein there are illustrated side and front views of antenna 10 according to the present invention. Antenna 10 includes a main reflector 12, a parabolic cylinder having a focal axis 14, and a sub-reflector 16 having a focal axis 18. Reflector 12 and sub-reflector 16 are positioned so that focal axes 14 and 18 thereof are mutually orthogonal and a point source on focal axis 18 is an image of a line source on focal axis 14; that is, the sub-reflector 16 is positioned between the focal axes 14 and 18 so that the image of point F on axis 18 lies along the axis 14. Accordingly, the system is confocal and operates substantially independently of the frequency of a feed for the antenna system. One interesting property of the antenna 10 is that when a point source feed 28 is placed at the point F and directed to irradiate the surface of the sub-reflector 16, an observer at infinity in the positive $z$ coordinate axis cannot determine whether the source lies along the axis 18 or the axis 14. Thus the axis 14 is said to contain a virtual source at the point F′ corresponding, in the $y$ coordinate axis, to the point F.

The reflector 12 and sub-reflector 16 intersect each other along a parabolic section formed by curve 20 defined parametrically by:

$$x = \frac{t^2}{4F_{c_1}} + F_{c_1} \tag{1}$$

$$y = t \tag{2}$$

$$z = \frac{\left(\frac{t^2}{4F_{c_1}} + F_{c_1}\right)^2}{4F_{c_2}} - F_{c_2} \tag{3}$$

where:

$F_{c_1}$ and $F_{c_2}$ are respectively the focal lengths of the sub-reflector 16 and the main reflector 12.

Reflector 12 is actually a truncated cylindrical parabola so that the portion thereof, shown by dotted line 13, below sub-reflector 16 and which cannot be illuminated by feed 28 does not actually exist. In practice, the main reflector is truncated with a plane 25 parallel to axis 14 and tangent to the sub-reflector as shown in FIG. 1B. The rectilinear truncated configuration of the main reflector 12 is more easily manufactured than the actual curve of intersection 20 and permits telescoping of the sections 24 and 26 of the main reflector without creating gaps at the curve of the intersection.

A section 22 of the sub-reflector 16 is a telescoping sleeve which can be closed to reduce the length of the sub-reflector in the Z-direction and similarly, the main reflector 12 contains telescoping sections or sleeves 24 and 26 which can be closed to reduce the length of the main reflector. In FIGS. 1A and 1B, telescoping portions 22, 24 and 26 are illustrated as closed (extended) to provide maximum surface areas for the reflector 12 and the sub-reflector 16; in FIGS. 2A and 2B, the telescoping portions are opened (withdrawn) to provide minimum surface areas.

The construction of the basic double parabolic cylinder antenna is described in U.S. Pat. No. 2,825,063 to Spencer, incorporated herein by reference. When the point source feed 28 is placed at the tip of main reflector 12 on axis 18 above the apex of sub-reflector 16 at point F in FIG. 1 and directed to irradiate the surface of the subreflector 16, spherical waves from the source 28 impinge on the surface of the sub-reflector 16 and reflect therefrom to irradiate the surface of the main reflector 12 as a virtual cylindrical wave. Although the reflecting surfaces are cylindrical in Spencer, a point source feed has been found to be satisfactory because a virtual cylindrical wave sector reflected from the sub-reflector 16 illuminates the main reflector 12. The position of the feed along the axis 18, the diameter and the focal lengths of the reflectors 12 and 16 can be varied somewhat without degrading the performance of the antenna so long as the main reflector is illuminated by the cylindrical wave reflected from the sub-reflector 16. For example, with the focal lengths being equal and the aperture size formed to six feet by four feet by choosing the diameters of the cylinders, the antenna operates satisfactorily at a frequency of 12.0 GHz. The cylindrical wave impinges on the surface of the main reflector 12, and because the axes 14 and 18 are orthogonal the wave emanates to the aperture plane as a plane wave. For example, in FIG. 1A, the ray $F\text{-}P_1\text{-}P_2\text{-}P_3$ emanates from the main reflector 12 parallel to the ray $F\text{-}P_4\text{-}P_5\text{-}P_6$ after two successive reflections.

The beamwidth BW is defined as:

$$BW = K\lambda/D \quad (4)$$

where:

D = diameter of aperture, $\lambda$ = wavelength of radiation,

BW = beamwidth of radiation at the −3 db points, and

K = geometry dependent constant factor.

From equation (4), it is apparent that the beamwidth of any antenna varies inversely with the aperture size. Since aperture size of the antenna corresponds to the area of the main reflector irradiated by the sub-reflector in the double parabolic cylinder antenna, it is apparent that the size of the aperture of the antenna is dependent upon the areas of both the reflector 12 and the sub-reflector 16. According to the present invention, the telescoping sections 24 and 26 of the main reflector 12 and the telescoping section 22 of the reflector 16 are made to slide behind and contiguous to the main and subreflectors for the purpose of controlling the surface areas thereof for beamwidth control.

Figure 2B:
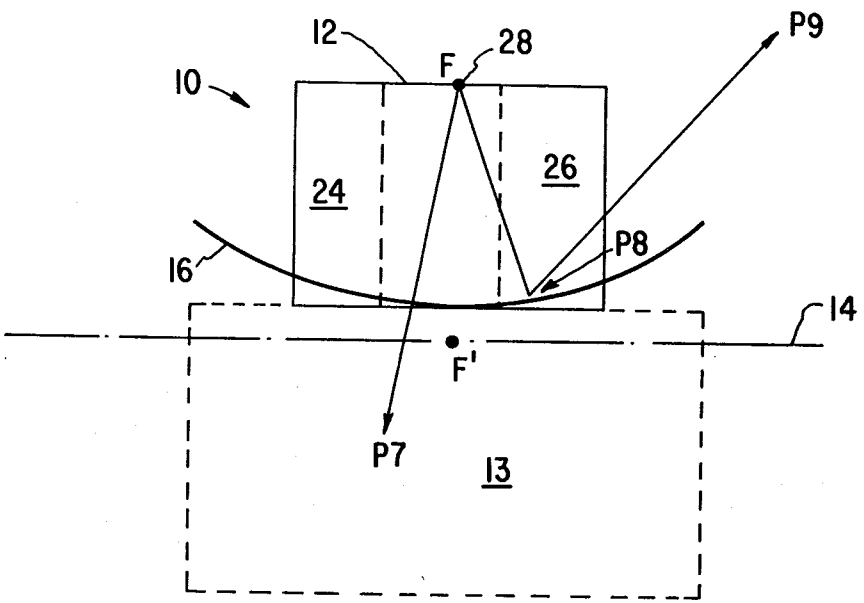
FIGS. 2A and 2B are respectively side and front views of the antenna of FIG. 1 with the telescoping sections closed.
Figure 2A:
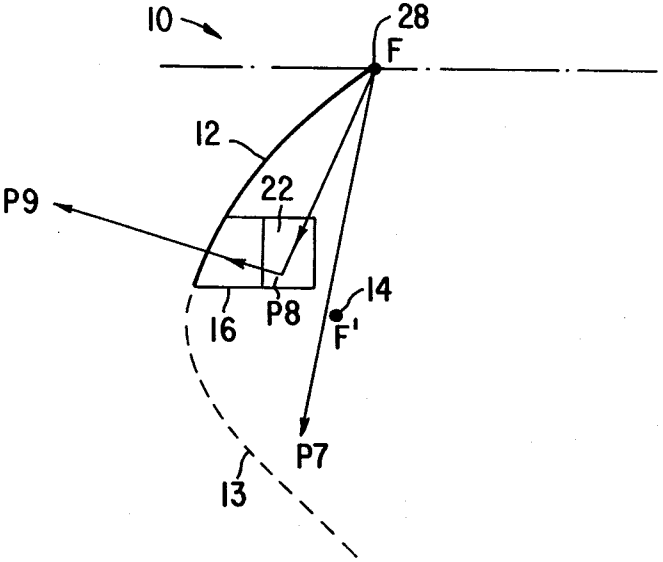

In FIG. 2A, the effect of closing the telescoping section 22 of the sub-reflector 16 is shown. A ray $F\text{-}P_7$ misses the retracted section 22 and "spills over" to be wasted by the antenna. In FIG. 2B, the telescoping sections 24 and 26 of the main reflector 12 are closed and a ray $F\text{-}P_8\text{-}P_9$ reflected from the sub-reflector 16 does not impinge the main reflector and "spills over" past the surface of the main reflector.

Figure 3B:
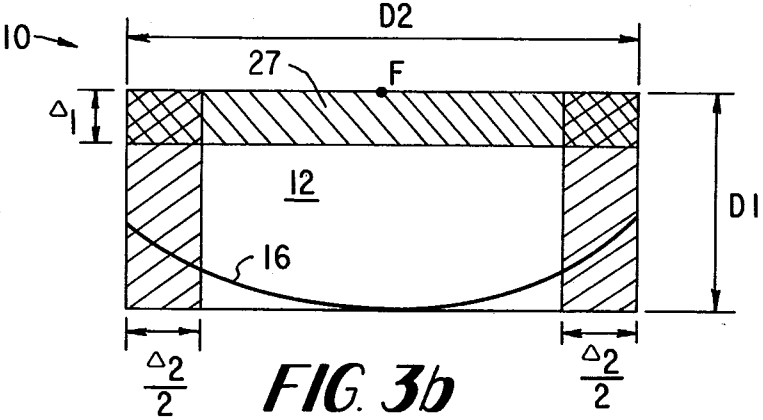
FIGS. 3A and 3B are respectively side and front views of the antenna showing the effect on the aperture of shifting the telescoping sections.
Figure 3A:
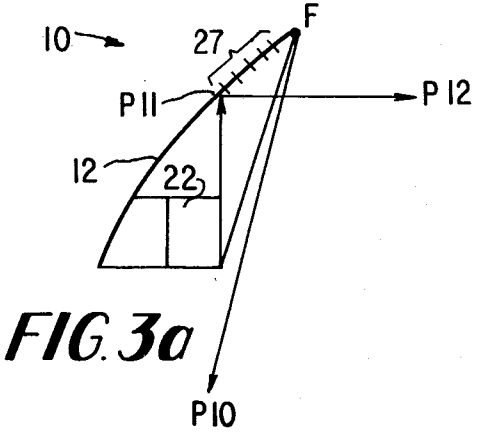

In FIGS. 3A and 3B, the way in which the telescoping sections 22, 24 and 26 control the size of the aperture is illustrated. Neglecting the area of the main reflector 12 beneath the sub-reflector 16 for simplicity, the lengths of the aperture in elevation and azimuth are $D_1$ and $D_2$, respectively.

In FIG. 3B, $\Delta_1$, is the amount by which the length of the aperture in elevation can be reduced with telescoping section 22, and similarly, $\Delta_2/2$ is the amount by which the lenth of the aperture in azimuth can be reduced with each of telescoping sections 24 and 26. It is clear that the length $D_2$ and thereby the azimuth dimension of the aperture is controlled directly by the telescoping sections 24 and 26 of the main reflector 12 and when the sections 24 and 26 are closed, the length $D_2$ of the aperture of the antenna azimuth is minimum. Referring to FIG. 3A, the telescoping section 22 is closed so that the ray $F\text{-}P_{10}$ spills over and is wasted while the ray $F\text{-}P_{11}\text{-}P_{12}$ reflects from the reflectors 12 and 16 to emanate from the antenna. The area 27 of the main reflector 12 cannot be irradiated when the section 22 is fully closed and therefore the length of the elevation aperture $D_1$ is reduced by the amount $\Delta_1$ in FIG. 3B. When the sections 24 and 26 are fully closed, the azimuth dimension is directly reduced by the amount $\Delta_2$. Since the elevation beamwidth is inversely proportional to the length $D_1$ and the azimuth beamwidth is inversely proportional to the length $D_2$, it is clear that by individually adjusting the telescoping sections of the main and sub-reflectors, beamwidth can be bidirectionally controlled.

Any suitable means for sliding the telescoping sections 22, 24 and 26 contiguous with the reflector and subreflector can be used. One practical means is to provide a rack and pinion mechanism controlled by a servo and secured between the telescoping section and a fixed portion of the reflector. Such a mechanism is shown in conjunction with the antenna 10 in FIG. 5.

Although a discontinuity in depth of the reflector and sub-reflector equal to the thickness of the material forming the antenna exists at the interface between the fixed and telescoping portions, the depth of the discontinuity is negligibly small compared to the wavelength of the radiation and can therefore be ignored.

Figure 5:
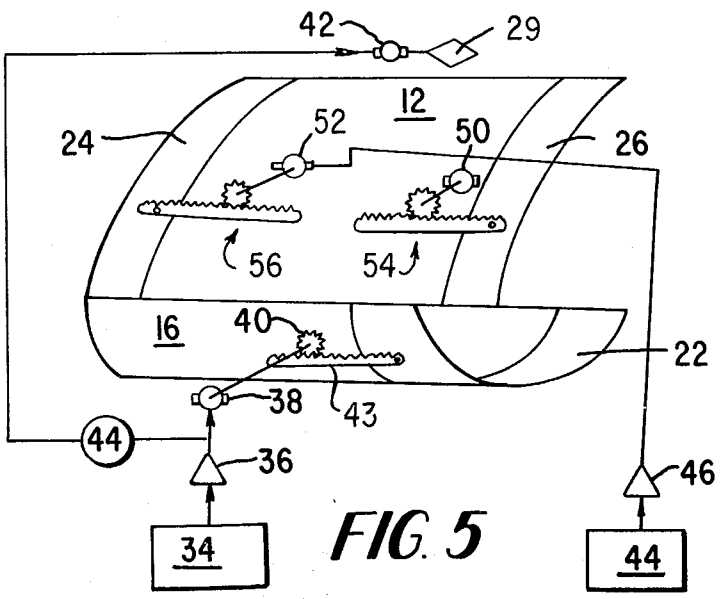
FIG. 5 is a perspective view of the antenna having a monopulse source with a system for controlling the telescoping sections and rotating the position of the feed, the telescoping secton of the main reflector closed and the telescoping section of the sub-reflector opened.
Figure 4:
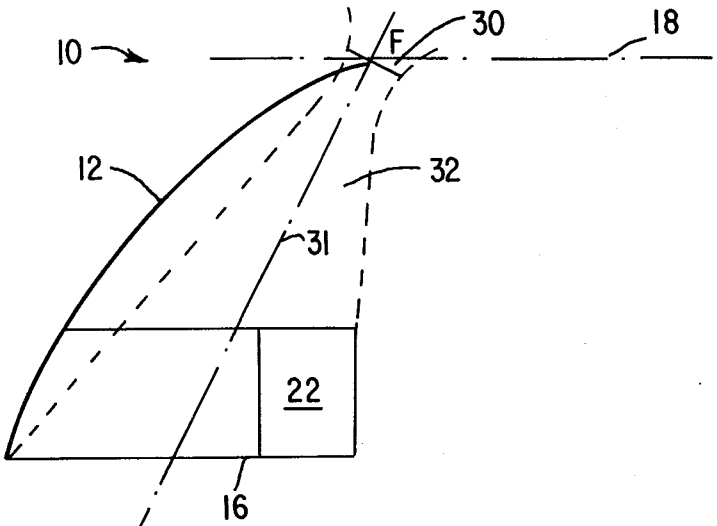
FIG. 4 is a side view of the antenna showing the position of the Airy disc.

The antenna system 10 in FIGS. 1–3 radiates a pencil beam with a point source feed of electromagnetic energy. According to the invention, the antenna functions as a multibeam, e.g., monopulse, antenna by positioning a multibeam feed at the point F to irradiate the sub-reflector 16, as illustrated in FIGS. 4 and 5. Although many types of multibeam feeds can be used, one preferred type comprises a monopulse feed having two pairs of feeds, each feed being slightly displaced from the point F in a diamond configuration to lie on a common wavefront of the fields in the focal region containing the point F and conventionally driven to produce a pattern of four squinted beams. One important consideration in the monopulse antenna of the invention is that the feeds at all times be positioned to lie on a common wavefront of the focal region fields of the system. In an ideal parabolic dish antenna, the focal region is generally illustrated as being a point. However, in a practical antenna system using finite wavelengths, the reflected waves converge as a bright disc and ring structure rather than as a point. This region is known as the Airy disc and in conventional antenna systems, such as a single parabolic reflector, the Airy disc lies parallel to the plane of the aperture. However, in the antenna 10, I have found that the Airy disc lies in a plane oblique to the plane of the aperture.

In FIG. 4, an Airy disc 30 shown in side view at the focal region F of the antenna 10 lies in a plane perpendicualr to central ray 31 of a conical volume 32 of the electromagnetic field existing between the surface of the subreflector 16 andd the focal area F of the antenna 10. Thus, contrary to what might be expected, I have found that the Airy disc lies parallel to neither the aperture of the main reflector 12 nor that of the sub-reflector 16 but rather is oblique to each. When the telescoping section 22 is closed, the righthand boundary of the conical volume 32 moves to the left following the section 22, the apex thereof fixed at F, and the central ray 31 rotates clockwise about the focal area F with the Airy disc 30 rotating correspondingly. In addition, the size of the Airy disc in the X-Y plane increases to render the disc oblong.

I have also found that when multiple feeds are positioned within the Airy disc 30 to irradiate the subreflector 16, the antenna 10 performs extremely well as a multibeam antenna and particularly as a monopulse antenna, creating no noticeable degradation of the squinted pattern as occurred in the prior art. It is important that the feeds remain within the Airy disc at all times, in view of the oblique orientation of the disc with respect to the aperture of the antenna and it is the position of the multibeam feed within the Airy disc 30 of the system which forms one important aspect of the invention.

I have discovered that beam zooming is provided in the multibeam antenna of the invention but it is necessary to compensate the rotational position of the feed with telescoping of the portion 22 to maintain the plane of the feed within the plane of the Airy disc. However, compensation is not necessary when telescoping the sections 24 and 26 of the main reflector 12 because the two sections provide a symmetrical change of geometry in the reflector and the position of the Airy disc is not changed thereby. Of course, the size of the Airy disc in the y-coordinate is affected but this is not important since, in practice, the feed is smaller than the minimum diameter of the Airy disc.

In FIG. 5, the antenna is shown in perspective. The telescoping section 22 is closed and the sections 24 and 26 are open. An elevation beamwidth control signal from source 34 is amplified by an amplifier 36 and applied to a servo 38. The servo 38 controls the rotation of a pinion 40 mounted to a fixed portion of the sub-reflector 16. The pinion 40 operates a rack 43, one end of which is secured to the telescoping section 22. In response to the signal from source 34, the telescoping section 22 is caused to slide contiguously to the fixed surface of the sub-reflector 16. In addition, the monopulse feed 29 is rotated by a servo 42 through a suitable attenuator 44 to compensate the feed for movement of the Airy disc caused by the telescoping section 22 as described in FIG. 4. The taper of attenuator 44, i.e., resistance vs. shaft angle, can be determined experimentally by measuring the rotational position of the Airy disc 30 both when the telescoping section 22 is opened and when it is closed. The difference in positions of the Airy disc determines the amount by which the monopulse feed 29 must be rotated during zooming and the attenuation factor of the attenuator 44 can easily be determined thereby. In practice, I have found that the Airy disc rotates approximately eight degrees with a full range of zooming of the telescoping section 22. The rotation of the Airy disc is not related linearly to the movement of the telescoping section 22 but can easily be determined either experimentally or by using conventional ray optics in FIG. 4 to sketch the position of the disc 30 as a function of the position of section 22.

An azimuth beamwidth signal from source 46 is amplified by an amplifier 48 and is applied equally to servos 50 and 52 which drive rack and pinion mechanism 54 and 56 to symmetrically control the position of the telescoping sections 24 and 26 of the main reflector 12. Alternatively, a single servo can drive both sectons with a rack and pinion mechanism and suitable gearing.

Figure 6:
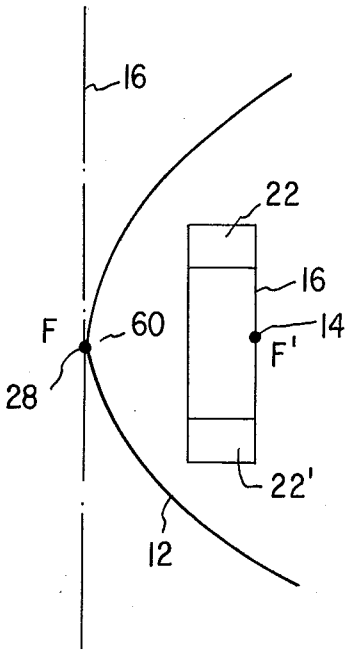
FIG. 6 is a side view of another embodiment of the present invention.

At the expense of main aperture obscuration, the described antenna system can be modified by rotating the source 28 and sub-reflector 16 by ninety degrees about the focal axis of the main reflector 12, as shown in the embodiment of FIG. 6. The antenna is again confocal, the point F lying on the focal axis 16 and the point F′ lying on the focal axis 14. Bidirectional zooming is provided with telescoping sections 24 and 26 on main reflector 12 and telescoping sections 22 and 22′ on sub-reflector 16. Sections 24 and 26 are not visible in the side view of FIG. 6 but are identical to sections 24 and 26 in FIG. 1B. The feed 28 is preferably positioned to the rear of the main reflector 12 to view the sub-reflector 16 through an opening 60 in the main reflector. Because there is no intersection of surfaces, the lower portion of the main reflector 12 is restored and the sections 22 and 22′ are adjusted symmetrically.

Because neither the horn feed nor the sub-reflector blocks radiation in the aperture of the embodiment of FIGS. 1–5, a highly efficient directional monopulse or other multibeam antenna is provided. In addition, because both embodiments of the system are confocal and use no polarization sensitive components, a free choice of frequency and polarization of the source is provided.

While there have been described and illustrated several specific embodiments of the invention, it will be clear that variations in the details of the embodiments specifically illustrated and described may be made without departing from the true spirt and scope of the invention as defined in the appended claims. For example, while the sub-reflector has been illustrated as being a parabolic cylinder, it is clear that other sub-reflector geometries could be used so long as the sub-reflector 16 is positioned to completely illuminate the main reflector 12 of the antenna with a cylindrical wave sector.

What is claimed is:

1. An antenna comprising:

a parabolic cylindrical main reflector having a first focal axis;

a cylindrical sub-reflector having a second focal axis;

said main reflector and sub-reflector being positioned with said first and second axes orthogonally and a point source on said second axis being an image of a line source on said first axis; and a multibeam feed for transducing electromagnetic waves, said feed being positioned in a plane of an Airy disc of the antenna, said waves being reflected between said subreflector and said main reflector, said Airy disc lying on said second focal axis and said plane being oblique to said axes.

2. The antenna of claim 1 wherein said cylindrical sub-reflector is parabolic.

3. The antenna of claim 1 wherein said multibeam feed is a monopulse feed.

4. The antenna of claim 1 wherein said main reflector includes a surface having a first surface area, said sub-reflector includes a surface having a second surface area, and means for controlling the size of the surface area of one of the reflectors to vary the aperture size of the antenna in a coordinate direction of the antenna.

5. The antenna of claim 4 further including means for rotating the position of said multibeam feed for changes in position of said Airy disc as a result of changes of the surface areas of the reflectors.

6. The antenna of claim 5 wherein said means for controlling controls the sub-reflector, and said means for rotating includes means for controlling the rotational position of said feed about a line parallel to said first axis as a function of the size of said sub-reflector.

7. The antenna of claim 4 wherein said means for controlling includes means for adjusting the axial lengths of said main reflector and said sub-reflector.

8. The antenna of claim 4 wherein said means for controlling includes means for adjusting the axial length of said sub-reflector.

9. The antenna of claim 4 wherein said means for controlling includes means for adjusting the axial length of said main reflector.

10. The antenna of claim 9 wherein said controlling means includes for adjusting a pair of telescoping sections on said main reflector symmetrically relative to the intersection of said axes.

11. The antenna of claim 9 wherein said adjusting means includes a telescoping section contiguous to said main reflector and slidable to adjust the axial length thereof.

12. An antenna comprising:

a parabolic cylindrical main reflector having a first focal axis;

a cylindrical sub-reflecor having a second focal axis;

said main reflector and sub-reflector being positioned with said first and second axes orthogonally and a point source of said second axis being an image of a line source on said first axis;

a feed for transducing waves of electromagnetic energy positioned on said second axis to form a pattern that irradiates said sub-reflector and is reflected between said sub-reflector and main reflector to illuminate said main reflector; and means for controlling the size of the surface area of at least one of said reflectors, wherein at least one of said main reflector and said sub-reflector includes a telescoping section and a fixed section, said telescoping secton adapted to slide contiguously to said fixed portion whereby bidirectional zooming of a beam is provided.

13. The antenna of claim 12 wherein said cylindrical sub-reflector is parabolic.

14. The antenna of claim 12 wherein said telescoping section is driven by a rack and pinion mechanism, a pinion being secured to said fixed section and rotated to drive a rack fixed to said telescoping section.

15. A double parabolic cylinder antenna of the type having a parabolic cylindrical main reflector and a parabolic cylindrical sub-reflector, said reflectors positioned with their focal axes orthogonally and a point source on said subreflector focal axis being an image of a line source on said main reflector focal axis, and a feed for transducing electromagnetic waves positioned on said sub-reflector focal axis to form a pattern that irradiates said sub-reflector, said pattern being reflected between said main reflector and sub-reflector to illuminate said main reflector, the improvement comprising:

means for selectively controlling the size of the surface areas of said sub-reflector and main reflector to provide continuous bidirectional zooming of the pattern, wherein the feed comprises a multibeam feed positioned entirely within an Airy disc of said antenna; and means for rotating the position of said feed so that it remains within said Airy disc during zooming.

16. An antenna comprising:

a parabolic cylinder main reflector having a first focal axis;

a parabolic cylinder sub-reflector having a second focal axis, said reflector and sub-reflector positioned with their axes orthogonally, said sub-reflector intersecting said first axis and said main reflector intersecting said second axis;

a feed for transducing electromagnectic waves positioned tangentially to said main reflector along said second axis and irradiating said sub-reflector; and means for adjusting the size of the surface area of at least one of said reflector and said sub-reflector.

17. The antenna of claim 16 wherein said means includes means for adjusting the axial length of said main reflector.

18. The antenna of claim 16 wherein said means includes means for adjusting the axial length of said sub-reflector.

19. The antenna of claim 16 wherein said means includes means for adjusting the axial lengths of both said main reflector and said sub-reflector.

20. A reflector for an antenna system, said reflector comprising:

a first parabolic cylinder having a first focal axis;

a second parabolic cylinder having a second focal axis; said first and second parabolic cylinders positioned with said first and second axes orthogonally;

said first parabolic cylinder being truncated by a plane tangent to said second parabolic cylinder and parallel to said first focal axis; and means for adjusting the size of the suurface area of at least one of said first and second parabolic cylinders.

21. The reflector of claim 20 including a feed for transducing electromagnetic waves, said feed positioned along said second axis adjacent said first reflector.

22. The reflector of claim 20 wherein said means for controlling includes means for adjusting the axial length of said first cylinder.

23. The reflector of claim 22 wherein said means for controlling includes means for adjusting the axial length of said second cylinder.

24. The reflector of claim 20 wherein said first and second cylinders are further positioned so that a point source on said second axis forms an image of a line source on said first axis.

25. The reflector of claim 20, wherein said means includes means for adjusting the axial length of at least one of said cylinders parallel to the focal axis thereof.

26. An antenna comprising:

a parabolic cylinder main reflector having a first focal axis;

a parabolic cylinder sub-reflector having a second focal axis, said reflector and sub-reflector positioned with their axes orthogonally, said sub-reflector intersecting said first axis and said main reflector intersecting said second axis;

a feed for transducing electromagnetic waves positioned tangentially to said main reflector along said second axis and irradiating said sub-reflector; and means for adjusting the axial length of at least one of said cylinders parallel to the focal axis thereof.

* * * * *